US005701706A

United States Patent [19]

Kreysler et al.

[11] Patent Number: 5,701,706

[45] Date of Patent: Dec. 30, 1997

[54] UNDERGROUND SERVICE BAY FOR VEHICLES AND PROCESS FOR CONSTRUCTING SAME

[76] Inventors: William Kreysler, 363 El Faisan Dr., San Rafael, Calif. 94903; Serge Labesque, 2300 Warm Springs Rd., Glen Ellen, Calif. 95442; Kurt Jordan, 242 B. Evergreen Ave., Mill Valley, Calif. 94941; Mark Luzaich, 925 Birkdale Ct., Windsor, Calif. 95492; David Colombo, 3292 Holland Dr., Santa Rosa, Calif. 95404; Edward J. Marcus, 1928 San Salvador Dr., Santa Rosa, Calif. 95403; Richard Koosa, 4201 Pressley Rd., Santa Rosa, Calif. 95404

[21] Appl. No.: 404,202

[22] Filed: Feb. 23, 1995

[51] Int. Cl.[6] ..... E02D 29/00; E04H 6/42

[52] U.S. Cl. ..... 52/169.6; 52/174; 52/169.7; 137/234.6; 184/1.5

[58] Field of Search ..... 52/169.6, 169.7, 52/174; 137/234.6; 184/1.5, 106

[56] References Cited

U.S. PATENT DOCUMENTS

| | | | |
|---|---|---|---|
| 1,654,073 | 12/1927 | Fagan | 52/174 X |
| 2,872,709 | 2/1959 | Brem | 137/234.6 |
| 3,173,387 | 3/1965 | Cree, Jr. | 52/169.6 X |
| 4,188,985 | 2/1980 | Osterman | 137/234.6 X |
| 4,226,062 | 10/1980 | Doane . | |
| 4,284,173 | 8/1981 | Patterson | 137/234.6 X |
| 4,789,047 | 12/1988 | Knoblock | 52/174 X |
| 4,805,360 | 2/1989 | Kuehal | 52/169.6 X |

FOREIGN PATENT DOCUMENTS

| | | | |
|---|---|---|---|
| 2 610 349 | 8/1988 | France . | |
| 3323692 | 1/1985 | Germany | 52/169.6 |
| 43 12 308 | 11/1994 | Germany . | |
| 0576025 | 1/1982 | Japan | 52/169.6 |

*Primary Examiner*—Carl D. Friedman
*Assistant Examiner*—Winnie Yip
*Attorney, Agent, or Firm*—Townsend and Townsend and Crew, LLP

[57] ABSTRACT

A prefabricated service bay typically constructed of fiberglass has a tank-like profile with an access opening for providing access to the underside of a vehicle. The prefabricated service bay is placed within an excavated hole within a vehicle service stall. The tank has a rounded section normal to the longitudinal axis of the bay. Drainage fill, such as pea gravel, is used between the bottom portion of the excavation and the bottom portion of the tank. A concrete cap is poured and cured over the top portion of the tank adjacent the opening. This poured and cured concrete serendipitously forms paired tracks for rolling placement of the wheels of a vehicle being serviced and additionally serves to key and maintain the service bay within the ground. Provision is made to provide a central standing area—preferably in the form of a raised platform—in the center bottom portion of the tank. Entrance and exit to the bay is provided through an end passageway with optional side staircase entry. Required accessories for material storage and the capture of fluids can be integrally built into the interior of the prefabricated unit. When installed, the service bay forms the required outer tank lining of a regulation required double lining system for oil storage underground.

9 Claims, 4 Drawing Sheets

UNDERGROUND SERVICE BAY FOR VEHICLES AND PROCESS FOR CONSTRUCTING SAME

This invention relates to underground service bays for vehicles. More particularly, an apparatus and process for the installation of an underground service bay is disclosed, which utilizes a tank shaped prefabricated shell, preferably of fiberglass, for the fabrication and installation of the service bay.

BACKGROUND OF THE INVENTION

So-called "service bays" are well known. Specifically, a pit is provided in the central portion of a vehicle service stall within a vehicle repair or service facility. The vehicle being serviced is parked within a service stall. The service stall contains a pit large enough to accommodate a service technician. The vehicle is parked so as to straddle the service bay and exposes its underside downward into the service bay. Service personnel within the service bay gain easy access to the vehicle for required service, including draining of engine fluids.

Usually, such service bays have been conventionally constructed concrete structures. A hole is first excavated. Thereafter, conventional wooden forming for concrete is built within the hole. This concrete is thereafter poured and cured. Upon curing, applicable forms are stripped and the service bay fitted with the required interior for the servicing of vehicles.

Some service bays are quite large. For example, it is known to construct pits in the order of 16 feet by 16 feet when viewed in plan. Across such pits, tracks for the support of vehicles are placed. Due to the large span, it is required that the tracks be supported by a system of columns having approximate five foot centers. It will be understood that such columns interfere with worker movement and render the layout of the pits awkward.

In Doane U.S. Pat. No. 4,226,062 issued Oct. 7, 1980 and entitled MOLDED STORAGE RECEPTABLE (sic), a prefabricated underground structure is illustrated. This structure is elongate, has vertical side and end walls and is provided with access including an integral staircase located at one end. The structure is set forth as preferably including a removable top. Transverse spacing of the opening is the same as the overall prefabricated structure width. The disclosure includes the use of the structure as a vehicle service bay.

SUMMARY OF THE INVENTION

A prefabricated service bay typically constructed of fiberglass has a tank-like profile with an access opening for providing access to the underside of a vehicle. The prefabricated service bay is placed within an excavated hole, within a vehicle service stall. The tank has a rounded section normal to the longitudinal axis of the bay. Drainage fill, such as pea gravel, is used between the bottom portion of the excavation and the bottom portion of the tank. A concrete cap is poured and cured over the top portion of the tank adjacent the opening. This poured and cured concrete serendipitously forms either paired tracks for rolling placement of the wheels of a vehicle being serviced or forms a reinforced portion of the cap to which such tracks can be conveniently fastened. Most importantly, the poured and cured concrete cap serves to key and maintain the service bay within the ground. Provision is made to provide a central standing area—preferably in the form of a raised platform— in the center bottom portion of the tank. Entrance and exit to the bay is provided through an end passageway with optional side staircase entry. Required accessories for material storage and the capture of fluids can be integrally built into the interior of the prefabricated unit. When installed, the service bay forms the required outer tank lining of a regulation required double lining system for oil storage underground.

It will be appreciated that fluids drained from vehicles when stored underground are treated as hazardous materials. Such materials are now required to be stored in double lined tanks. It will be observed that prefabricated service bay unit U forms such a lining.

It will be understood that the concrete cap here disclosed eliminates conventional steel gratings utilized with service bays. Service bays when made in a rectilinear configuration either are too narrow—or alternately are the full width of the vehicles being serviced. When the service bays are the full width of the vehicles being serviced, grates are required. Specifically, the grates must extend a sufficient distance inward from the sides of the bay to permit vehicle support.

DESCRIPTION OF THE PREFERRED EMBODIMENT

Figure 1:
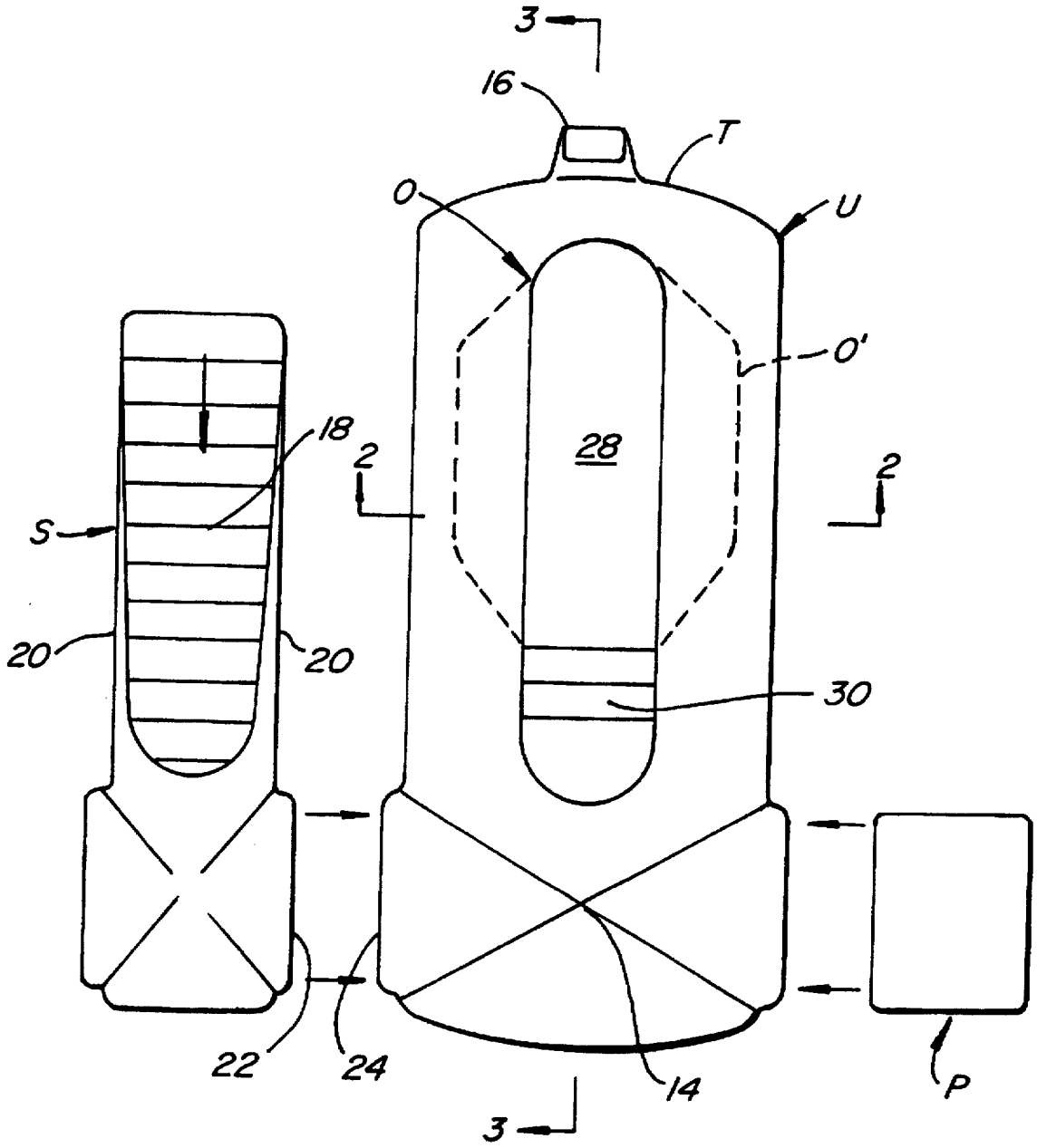
FIG. 1 is a plan view of the tank-shaped prefabricated service bay for forming a single service bay for a vehicle, the prefabricated unit being show before installation with a prefabricated staircase illustrated to one side of the bay and a passage to an adjoining bay (not shown) illustrated on the opposite side.

Referring to FIG. 1, prefabricated service bay unit U is illustrated in plan before installation within the ground. Prefabricated service bay unit U includes access opening O formed in generally tank T. Tank T is generally symmetrical about central cylindrical axis 14. In the preferred construction, prefabricated service bay unit U is constructed of fiberglass and laid up against a suitable mold by conventional fiberglass construction techniques.

The reader will understand that it is not required that tank T be cylindrical—having a circular cross-section. The cross-section can be elliptical, parabolic or generally arcuate. It is required that at the top of the tank adjacent access opening O the walls of the tank must be convex, in the sense that the shoulders of the tank adjacent access opening O are curved.

It will be understood that access opening O will admit of some modification. Specifically, and where service bay is intended for brake work and the line, gratings defining part of the tracks of the vehicle may be used. In this case portions of a cap—such as that made from poured and cured concrete—may be used to support gratings which are part of the tracks for supporting a vehicle straddling the access opening. Such an enlarged access opening O' is indicated in broken lines in plan on FIG. 1.

It will be noted that the end of the tank adjacent underground passage modules P and staircase unit S is other than complete rounded. These sections can depart from the arcuate configuration so as to accommodate the dimensions required for personnel passage.

The relationship between access opening O and tank T is important. Specifically, access opening O has a dimension less than the full diameter of tank T. This enables the tank adjacent access opening O to expand outwardly and under prefabricated service bay unit U. As will hereafter be realized, this configuration enables ready keying of prefabricated service bay unit U within the ground. Further, this configuration enables tire tracks for support of a vehicle straddling the bay to be formed when a cap of concrete is poured and cured overlying prefabricated service bay unit U.

It is desirable to allow easy entrance and exit from prefabricated service bay unit U. Accordingly staircase unit S can be supplied having stairs 18 with sidewalls 20, underground passage 22 through removable wall section 24 in prefabricated service bay unit U.

Likewise, it can further be desirable to have communication between respective prefabricated service bay units U. Accordingly, one or more underground passage modules P can be provided to accommodate passage between respective side-by-side prefabricated service bay units U.

It thus be seen that the disclosed prefabricated service bay unit U is in effect a modular design. Staircase unit S and underground passage modules P are interchangeable. The units can be placed in any desired combination to fit the requirements of any particular service site.

In what follows, we illustrate the placement of prefabricated service bay unit U within the ground. It will be understood that such placement may as well include staircase unit S and underground passage modules P.

Figure 2:
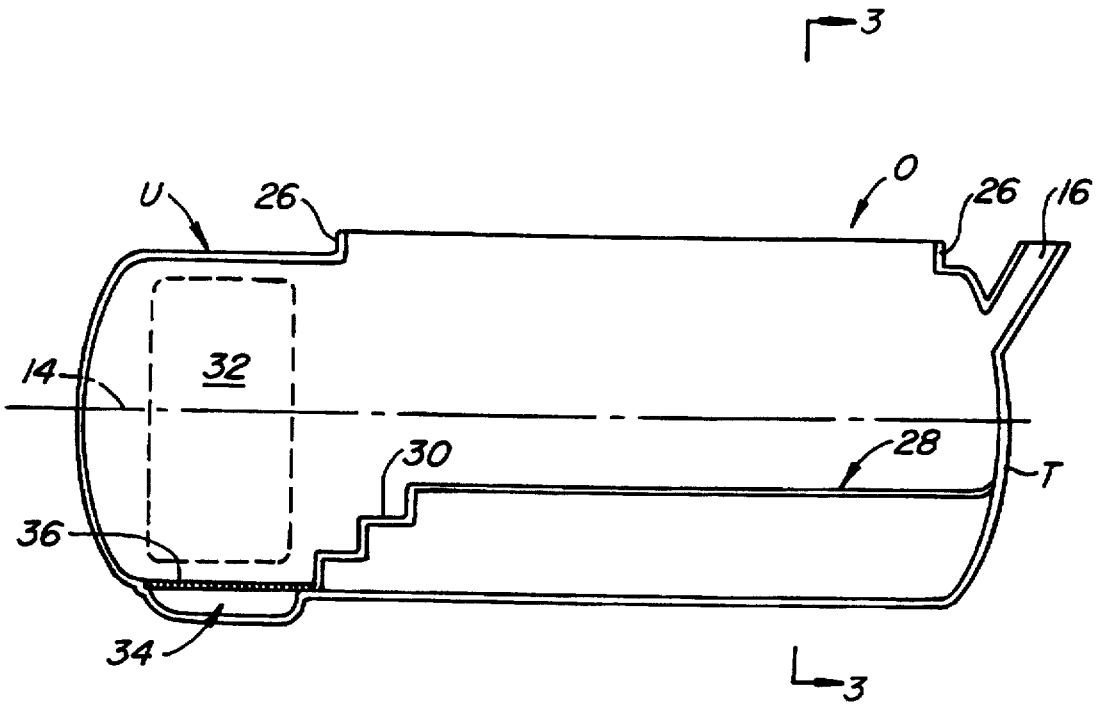
FIG. 2 is a longitudinal section taken along lines 2—2 of FIG. 1 illustrating the central opening, a grating and sump, a central work platform, and a supply entry slot for passing supplies such as fresh motor oil to the service bay.

Referring to FIG. 2, five additional features of prefabricated service bay unit U can be noted. First, access opening O includes screed 26 extending peripherally around the opening. As will hereafter be understood, screed 26 provides a barrier against which a concrete cap can be poured and cured when prefabricated service bay unit U is set in place. It will be seen that screed 26 enables a suitable thickness to be imparted to a poured and cured concrete cap to enable the concrete cap to support the weight of a vehicle being serviced.

Secondly, prefabricated service bay unit U is provided with central work platform 28 having stairs 30 leading up to the level of the platform. This allows service personnel easy access to the underside of vehicles parked in the service stall under which prefabricated service bay unit U is placed.

Thirdly, removable side access panel 32 is provided. Removable side access panel 32 provides access to staircase unit S and underground passage modules P so that convenient entrance and exit can be made.

Fourth, and as shown, tank T includes supply chute 16. During service when exit from prefabricated service bay unit U is not desired, supplies can be rapidly passed to and from the interior of the service bay.

Finally, prefabricated service bay unit U is provided with sump 34 covered at grating 36. Sump 34 is a convenient low point in the unit from which all fluids may be conveniently evacuated. It will be understood that this low point defined at sump 34 covered by grating 36 also furnishes required headroom which is frequently code required at staircases.

It will be understood that it is in the very nature of prefabricated service bay unit U to accommodate on a preformed basis necessary accessories for service of vehicles. For example, and as shown in FIG. 3, shelves 29 can be either integrally made with or fastened before installation to prefabricated service bay unit U.

Figure 3:
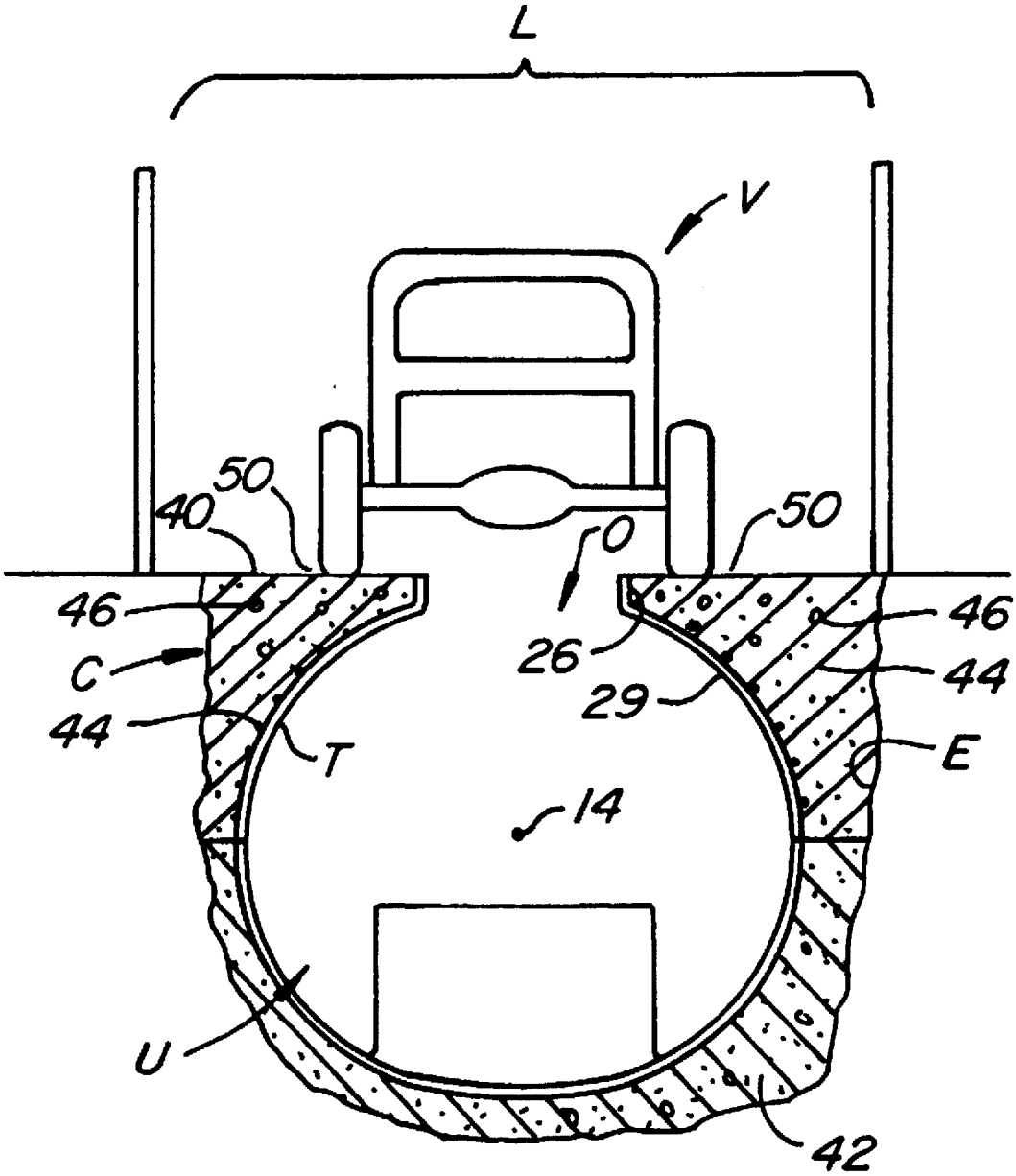
FIG. 3 is an end elevation section taken along lines 3—3 of FIG. 1 illustrating the central work platform, the overlying opening to the vehicle, the placement of poured and cured concrete to key the prefabricated service bay within the ground, and illustrating a vehicle over the service bay in a position where access to the vehicle underside may readily be gained; and, FIG. 4 is a side elevation section similar to FIG. 3 illustrating the combination of pea gravel and poured and cured concrete for maintaining the prefabricated unit within the ground.
Figure 4:
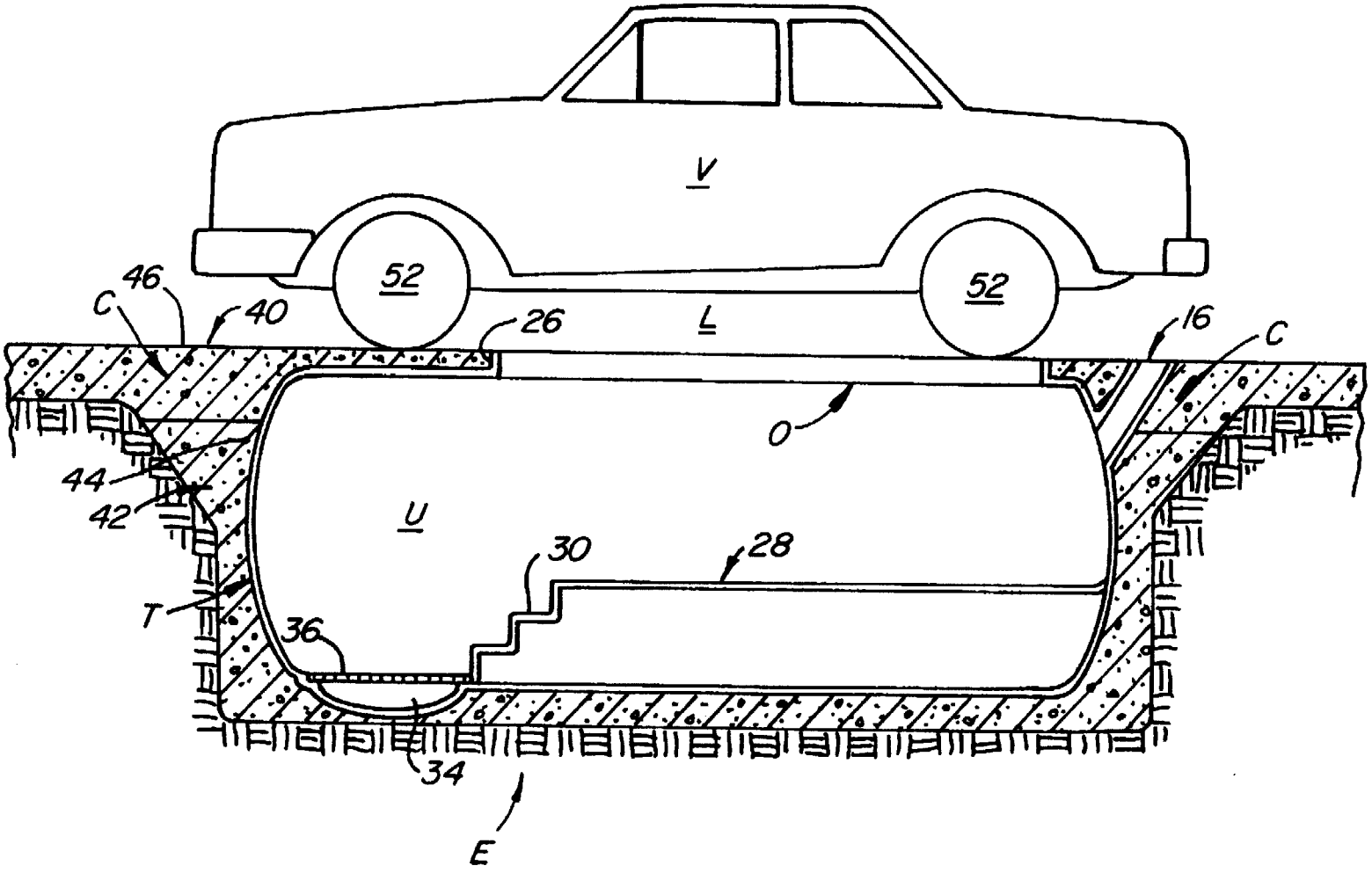

Referring to FIGS. 3 and 4, service stall L is shown occupied by vehicle V with prefabricated service bay unit U in place under the service stall. Some discussion about both the placement of prefabricated service bay unit U and its relationship to the support of vehicle V can be of assistance.

It is intended that prefabricated service bay unit U be installed under service stall L. Accordingly, excavation E is first made in sufficient dimension to receive tank T with screed 26 protruding to surface 40 of service stall L. In placement of prefabricated service bay unit U, that interval between the bottom of tank T and excavation E is typically filled with a filler material such as pea gravel 42. This provides both firm support and required drainage about prefabricated service bay unit U.

Typically, either tank attached reinforcement 44 or free standing reinforcement 46 is added about tank T adjacent access opening O. This reinforcement conventionally reinforces poured and cured concrete cap C. Thereafter, cap C is poured and cured locking prefabricated service bay unit U in place in excavation E.

Two important observations can be made relative to prefabricated service bay unit U and poured and cured concrete cap C. First, it will be observed that poured and cured concrete cap C extends from screed 26 to an expanded top section of tank T. This concrete effectively captures prefabricated service bay unit U within excavation E. Presuming that location of service stall L is in an area where underground flooding occurs, prefabricated service bay unit U will not be buoyantly dislodged from excavation E.

Secondly, poured and cured concrete cap C in effectively keying about access opening O at screed 26 forms paired tracks 50 for tires 52 of vehicle V. It will be seen that screed 26 enables a sufficient thickness of concrete to be placed over tank T to support the weight of vehicle V straddling the service bay. There is no need for the separate fabrication of tire track gratings and the like adjacent access opening O of prefabricated service bay unit U; placement of poured and cured concrete cap C includes placement of paired tracks 50.

Over conventionally constructed and rectilinear bays, it will be seen that the present construction offers numerous advantages. First, the cylindrical shape of tank T provides an expanded volume from the dimension of access opening O. This expanded volume enables service technicians to enjoy freedom of movement and ready access to tools and supplies. Further, the interior of the bay can be fitted with required shelves, tanks, tool racks and the like before placement in the ground. Most importantly, the entire service bay can be standardized to fit the specialty requirements of modern automotive service.

It will be understood that this invention will admit of modification. For example, the configuration of staircase unit S and entrances for underground passage modules P can all be modified. Likewise, the interior of prefabricated service bay unit U can be altered to accommodate that particular servicing being undertaken.

What is claimed is:

1. An underground service bay placed within the ground comprising:

a prefabricated unit for placement in the ground including a cylindrical tank body having a major axis of the cylindrical tank body parallel to a longitudinal direction of the underground service bay;

an access opening defined in an upper portion of the cylindrical tank body for exposure to a vehicle underside, the access opening having a width relative to the longitudinal direction of the underground service bay to occupy less than a diameter of the cylindrical tank body to enable the cylindrical tank body to have paired upwardly exposed tank sides on either side of the access opening;

the cylindrical tank body having a arcuate cross section normal to the major axis of the cylindrical tank body to provide an increased diameter below the access opening;

paired spaced apart vehicle supporting tracks defined over the upwardly exposed tank sides of the cylindrical tank body adjacent the access opening;

means for holding the prefabricated unit to the ground including a cap maintaining the cylindrical tank body within the ground against buoyant forces acting on the prefabricated unit.

2. An underground service bay placed within the ground according to claim 1 and further comprising:

the cap over the cylindrical tank body for forming vehicle supporting tracks includes poured and cured concrete.

3. An underground service bay placed within the ground according to claim 1 and further comprising:

the access opening defined in the cylindrical tank body includes a lip extending upwardly to and toward the vehicle underside, the lip for forming a screed about the access opening.

4. An underground service bay placed within the ground according to claim 1 and further comprising:

an elevated work platform mounted to a bottom of the cylindrical tank body and extending upwardly to and toward the access opening.

5. An underground service bay placed within the ground according to claim 1 and further comprising:

a supply chute extends from the prefabricated unit.

6. A prefabricated unit for placement in ground for forming an underground service bay for a vehicle comprising:

a prefabricated unit for placement in the ground including a cylindrical tank body having a major axis of the cylindrical tank body parallel to a longitudinal direction of the underground service bay;

an access opening defined in an upper portion of the cylindrical tank body for exposure to a vehicle underside, the access opening having a width relative to the longitudinal direction of the underground service bay to occupy less than a diameter of the cylindrical tank body to enable the cylindrical tank body to have paired upwardly exposed tank sides on either side of the access opening;

the cylindrical tank body having a arcuate cross section normal to the major axis of the cylindrical tank body to provide an increased diameter below the access opening;

paired spaced apart vehicle supporting tracks defined by the upwardly exposed tank sides of the cylindrical tank body adjacent the access opening.

7. A prefabricated unit for placement in ground for forming an underground service bay according to claim 6 and wherein:

the prefabricated unit includes a supply chute extending from the cylindrical tank body.

8. A prefabricated unit for placement in ground for forming an underground service bay according to claim 6 and wherein:

the prefabricated unit includes a screed about the access opening.

9. A prefabricated unit for placement in ground for forming an underground service bay according to claim 6 and wherein:

the prefabricated unit includes a central work platform elevated from bottom of the cylindrical tank body to and toward the access opening.

* * * * *